US005464329A

United States Patent [19]

Senoo et al.

[11] Patent Number: 5,464,329

[45] Date of Patent: Nov. 7, 1995

[54] WATER RING TYPE PUMP WITH SIDEWALL WATER REFLUX PASSAGE

[75] Inventors: Yasutoshi Senoo, Fukuoka; Nobuaki Yanagihara; Norio Yasu, both of Matsuyama, all of Japan

[73] Assignee: Miura Co., Ltd., Ehime, Japan

[21] Appl. No.: 249,264

[22] Filed: May 25, 1994

[51] Int. Cl.[6] ..... F04C 19/00

[52] U.S. Cl. ..... 417/68

[58] Field of Search ..... 417/68; 415/52.1, 415/58.4

[56] References Cited

U.S. PATENT DOCUMENTS

| | | |
|---|---|---|
| 3,894,812 | 7/1975 | Huse . |
| 4,545,730 | 10/1985 | Lubke . |
| 4,637,780 | 1/1987 | Grayden . |

FOREIGN PATENT DOCUMENTS

| | | | |
|---|---|---|---|
| 205156 | 2/1959 | Germany | 417/68 |
| 5180184 | 7/1983 | Japan | 417/68 |
| 31686 | 2/1986 | Japan | 417/68 |
| 5133369 | 5/1993 | Japan | 417/68 |
| 5133373 | 5/1993 | Japan | 417/68 |
| 5157077 | 6/1993 | Japan | 417/68 |
| 188951 | 7/1937 | Switzerland | 417/68 |
| 667688 | 6/1979 | U.S.S.R. | 417/68 |
| 1355193 | 2/1972 | United Kingdom | 417/68 |

*Primary Examiner*—Richard A. Bertsch
*Assistant Examiner*—Roland G. McAndrews, Jr.
*Attorney, Agent, or Firm*—Birch, Stewart, Kolasch & Birch

[57] ABSTRACT

In a water ring type vacuum pump, an impeller (6) having a plurality of blades (6*a*) is rotatably provided in a pump chamber (3) communicating with an air inlet (1*b*) and an air outlet (1*d*), and a water inlet (1*a*) for feeding sealing water to a center portion of the pump chamber is further provided. Sealing water that has moved to a peripheral wall portion (3*a*) of the pump chamber (3) flows back to a center portion (3*b*) of the pump chamber (3). By this arrangement, the sealability of sealing water can be improved and the sealing water can be saved in amount.

4 Claims, 7 Drawing Sheets

WATER RING TYPE PUMP WITH SIDEWALL WATER REFLUX PASSAGE

BACKGROUND OF THE INVENTION

1. Field of the Invention

The present invention relates to improvements in water ring type vacuum pumps.

2. Description of the Prior Art

In the water ring type vacuum pump, as is well known, sealing water within the pump chamber is rotated by an impeller so as to be moved radially of the impeller, whereby air is sucked and discharged. An example of the conventional water ring type vacuum pump is shown in FIG. 7. As an impeller 32 provided in a pump chamber 31 rotates, air sucked through an inlet 33 is discharged through an outlet 34 via the pump chamber 31. Sealing water is fed through a water inlet 35. The fed sealing water flows into the pump chamber 31 through a clearance between the inner wall surface of the pump chamber 31 and both side faces of the impeller 32, and thereafter is discharged through the outlet 34 along with air.

In this conventional sealing-water feeding construction, a greater clearance between the inner wall surface of the plump chamber 31 and both side faces of the impeller 32 would more often cause the air to leak through the clearance, resulting in a deteriorated pump performance. Also, even if the clearance is small, a small amount of water feed would lead to insufficient sealing performance of the water of the clearance between the inner wall surface of the pump chamber 31 and both side faces of the impeller 32. This also would result in a deteriorated pump performance.

SUMMARY OF THE INVENTION

Accordingly, the object of the present invention is to provide a water ring type vacuum pump which can prevent air from passing and leaking through the clearance between the inner wall surface of the pump chamber and both side faces of the impeller, and therefore from any deterioration in pump performance due to such air leak.

The present invention, having been achieved to solve the above problems, provides a water ring type vacuum pump in which an impeller equipped with a plurality of blades is rotatably provided in a pump chamber communicating with an air inlet and an air outlet and in which a water inlet for feeding sealing water to a center portion of the pump chamber is further provided, the water ring type vacuum pump characterized in that the sealing water that has moved to a peripheral wall portion of the pump chamber is returned to the center portion of the pump chamber.

The sealing water fed to the center portion of the pump chamber through the water inlet passes through the clearance between the inner wall surface of the pump chamber and both side faces of the impeller, flowing toward the peripheral wall portion. At the peripheral wall portion of the pump chamber, the sealing water rotates along with the impeller at a generally constant thickness. Due to the action of centrifugal force, the pressure of the pump chamber is higher at its peripheral wall portion than at its center portion. As a result, the sealing water passes through a reflux passage that makes the center portion and the peripheral wall portion of the pump chamber communicating with each other, flowing back from the peripheral wall portion of the pump chamber to the center portion of the pump chamber. The sealing water that has flowed back flows again through the clearance between the inner wall surface of the pump chamber and both side faces of the impeller toward the peripheral wall portion. The sealing water is formed into a thin film between adjoining blades of the impeller, thereby sealing end faces of the blades. Thus, the sealing water prevents air from leaking through the clearance between the inner wall surface of the pump chamber and both side faces of the impeller.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Actual embodiments of the present invention are now described in detail with reference to the accompanying drawings. First described is a single-stage water ring type vacuum pump.

Figure 1:
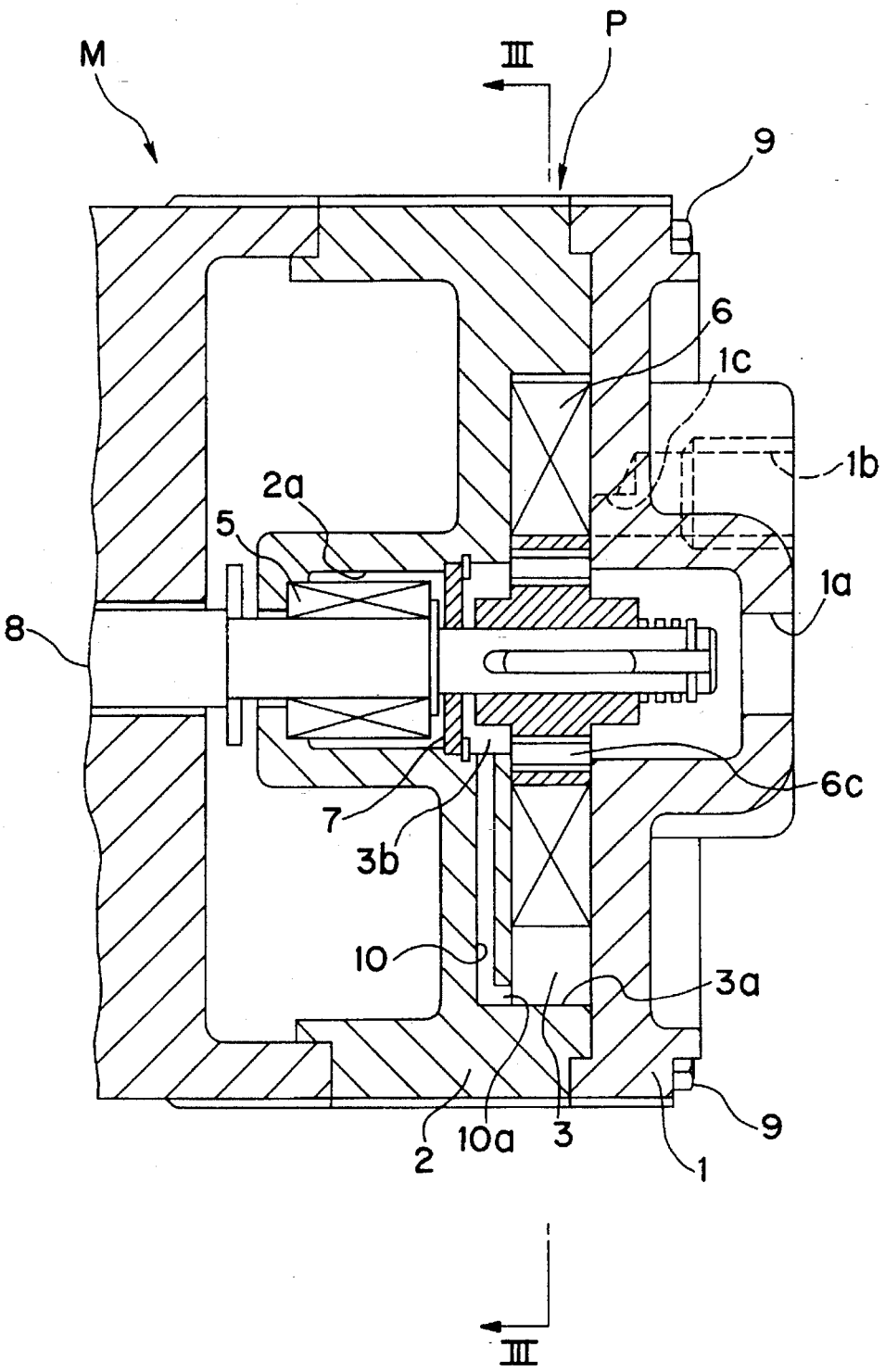
FIG. 1 is a longitudinal sectional view showing an embodiment of the water ring type vacuum pump according to the present invention.

As shown in FIG. 1, the water ring type vacuum pump of the present invention comprises a pump section P and a motor section M, the pump section P being connected to the motor section M by bolts 9. The pump section P includes a first casing 1 located on the sealing-water feed side, and a second casing 2 located on the motor section M side. A pump chamber 3 is defined between the first casing and the second casing 2. In this pump chamber 3, an impeller 6 is rotatably provided so as to be decentered to a specified extent. The impeller 6 is secured to a rotating shaft 8. The motor section M has a drive motor (not shown) provided therein and supports the rotating shaft 8 in such a way that the rotating shaft 8 is rotatable.

Figure 2:
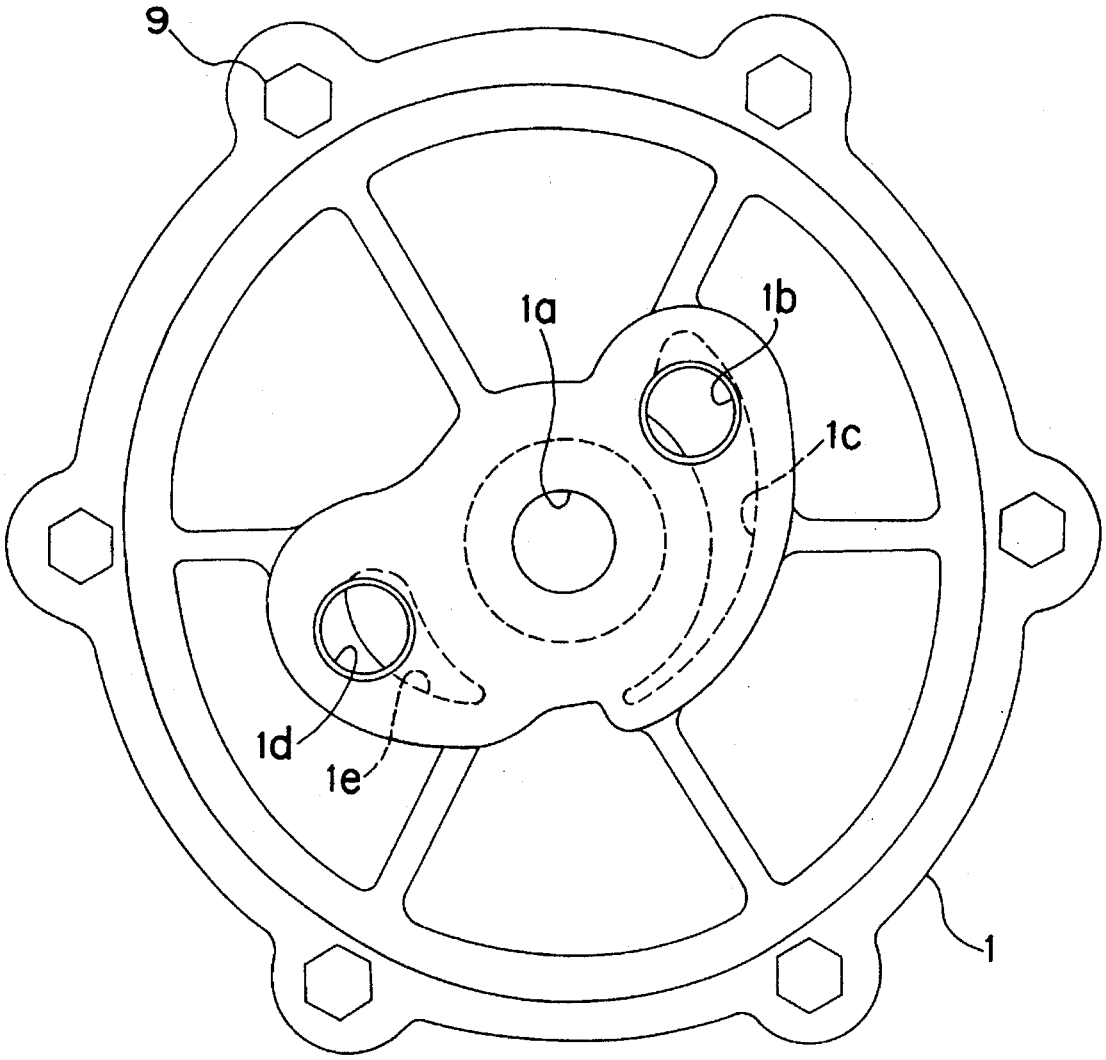
FIG. 2 is a right-hand side view of the water ring type vacuum pump of FIG. 1.

The first casing 1, as shown in FIG. 1 and FIG. 2, is formed generally into a disc shape, and has at its center a water inlet 1*a* communicating with the pump chamber 3. Sealing water is fed from the water inlet 1*a* to the pump chamber 3. As shown in FIG. 2, an air inlet 1*b* is provided diagonally upward of the water inlet 1*a*, and the air inlet 1*b* communicates with the pump chamber 3 via a suction port 1*c* of a generally crescent shape. An air outlet 1*d* is provided diagonally downward of the water inlet 1*a*, and the air outlet 1*d* communicates with the pump chamber 3 via a discharge port 1*e* of a generally crescent shape.

Figure 3:
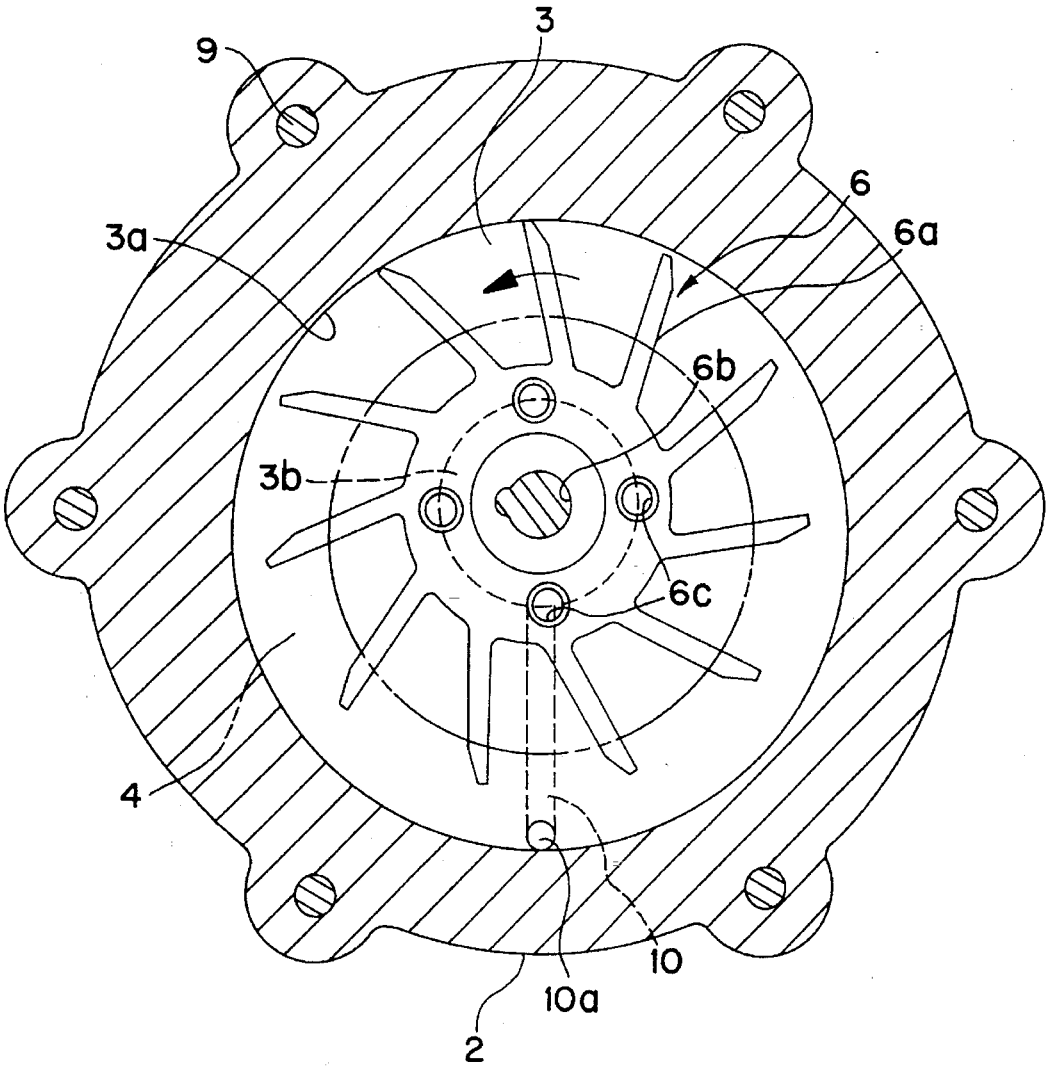
FIG. 3 is a sectional view taken along the line III—III of FIG. 1

The second casing 2, as shown in FIG. 1 and FIG. 3, is formed generally into a disc shape, and has at its center a mechanical seal box 2*a* for housing a mechanical seal 5. A mouth ring 7 is provided between the mechanical seal box 2*a* and the impeller 6. Further, the second casing 2 has a reflux passage 10 defined via an opening 10*a* so that a peripheral wall portion 3*a* and a center portion 3*b* of the pump chamber 3 communicate with each other.

It is noted that although the reflux passage 10 has been defined in the second casing 2 in the above-described embodiment, the reflux passage 10 may instead be defined in the first casing 1 and further may be defined in both of the two casings as the case may be.

The impeller 6, as shown in FIG. 1 and FIG. 3, is equipped with a plurality of blades 6*a* arranged generally radially, and has at its center a hole 6*b* for inserting the rotating shaft 8. A plurality of water passage holes 6*c* are provided around the hole 6*b* so as to pass through.

Next described is the action of the water ring type vacuum pump having the above construction. When the impeller 6 started rotating, sealing water fed from the water inlet 1*a* into the pump chamber 3 flows along the peripheral wall portion 3*a* of the pump chamber 3, circulating in annular form (see reference numeral 4 indicated by two-dot chain line in FIG. 3). Since the impeller 6 is decentered with respect to the center of the pump chamber 3, generally crescent-shaped spaces are defined between the blades 6*a* of the impeller 6 and the sealing water 4. These spaces expand and contract as the impeller 6 rotates, whereby air is sucked through the air inlet 1*b* and discharged through the air outlet 1*d*. In other words, air is sucked from the air inlet 1*b* into the pump chamber 3 via the suction port 1*c*, and thereafter discharged from the air outlet 1*d* via the discharge port 1*e*.

Figure 4:
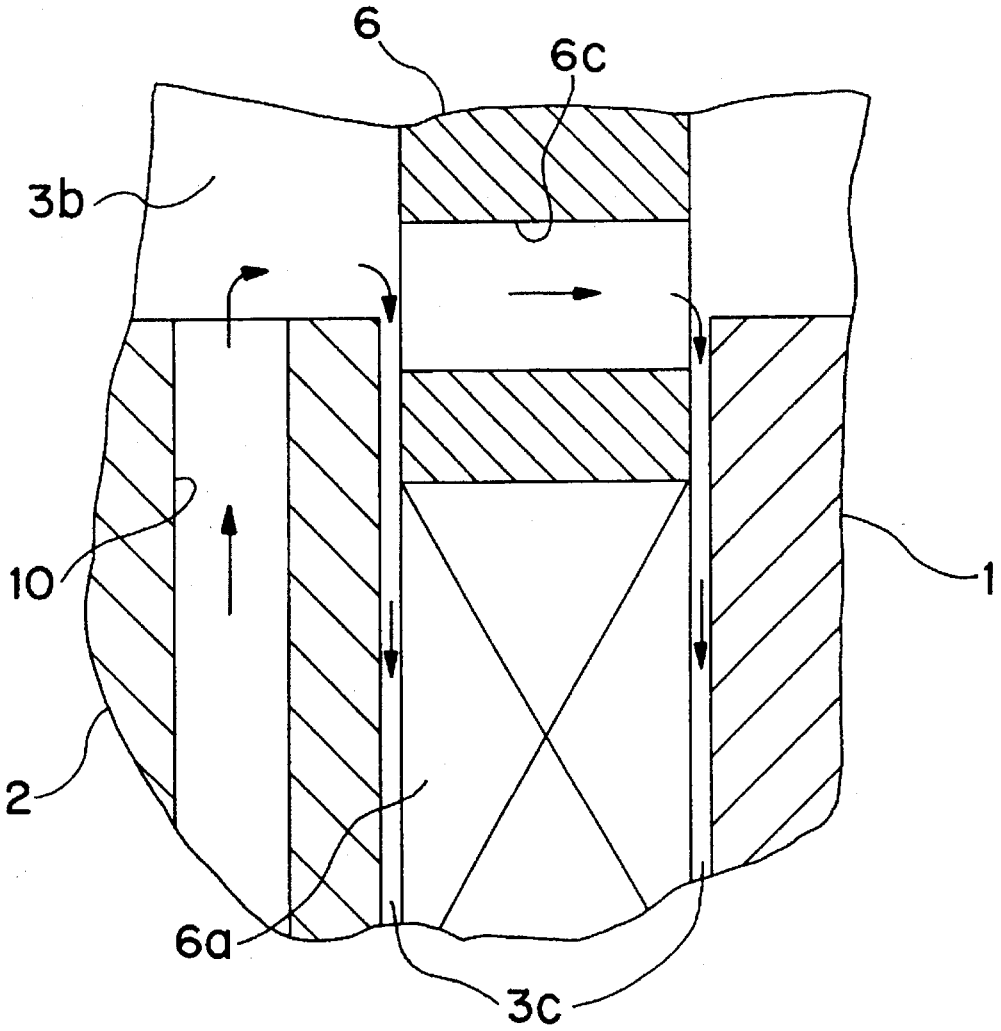
FIG. 4 is a sectional view showing the main part of FIG. 1 in enlargement.

As shown in FIG. 3, the sealing water 4 within the pump chamber 3 rotates at a generally constant thickness together with the impeller 6. Accordingly, due to the centrifugal force, the pressure in the pump chamber 3 is higher at the peripheral wall portion 3*a* than at the center portion 3*b*. Due to the resultant pressure difference, part of the sealing water passes through the reflux passage 10, flowing toward the center portion 3*b*. Then, as shown in FIG. 4, the sealing water flows out radially through clearances 3*c* between the side faces of the impeller 6 and the second casing 2, with the result that a water thin film is formed along the peripheral wall portion 3*a* of the pump chamber 3. This water thin film is scraped up by the side face of the blades 6*a* of the impeller 6, so that water heaps up at an end portion of their front face in the rotating direction. Thus, air is prevented from leaking over the side face of the blades 6*a*. Also, the sealing water in the center portion 3*b* of the pump chamber 3 flows into the opposite side of the impeller 6 via the plurality of water passage holes 6*c* provided at the boss portion of the impeller 6. As a result, as in the foregoing case, the sealing water flows into the clearances 3*c* between the side faces of the impeller 6 and the side faces of the first casing 1, preventing air from leaking.

Figure 5:
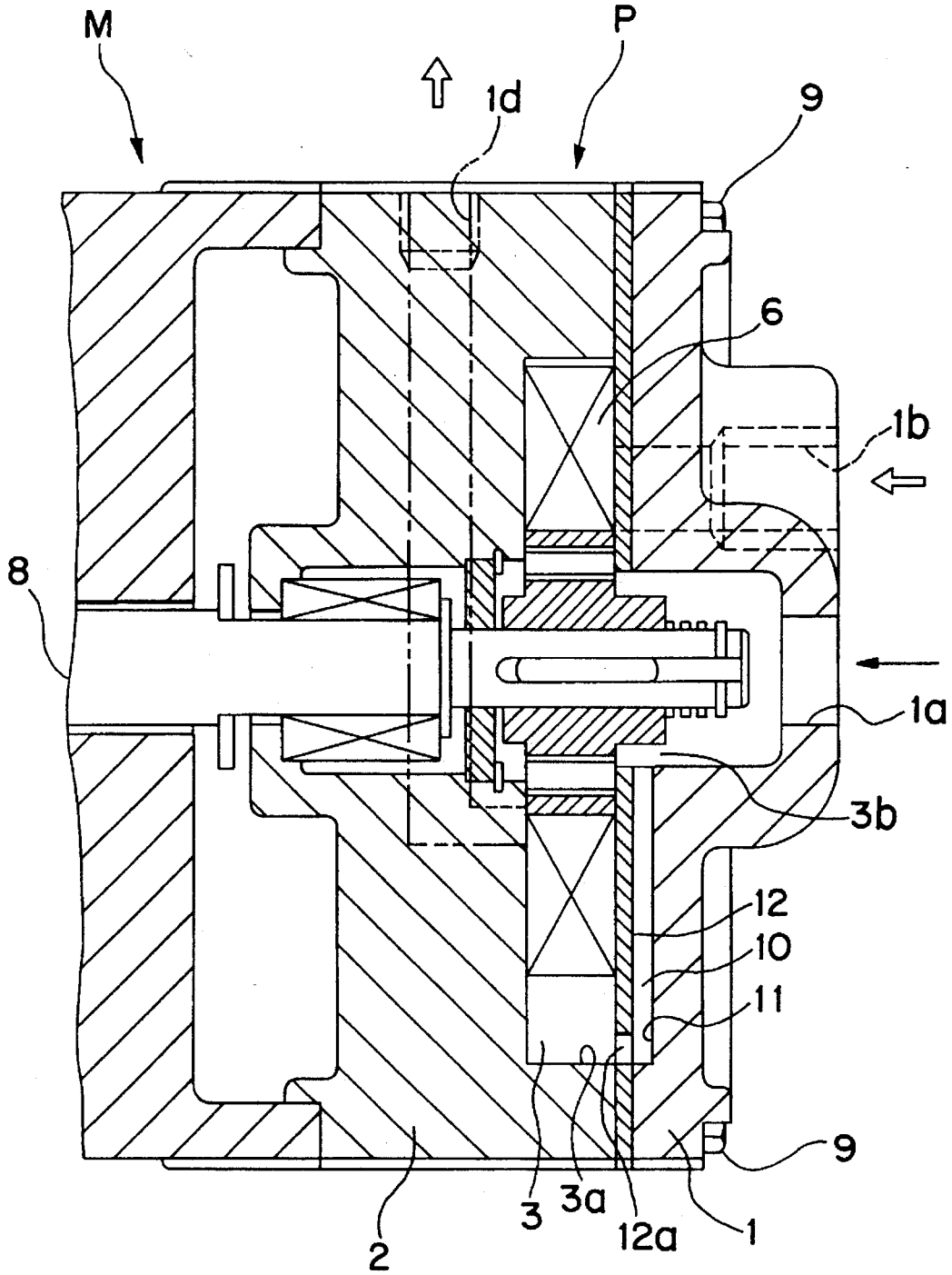
FIG. 5 is a longitudinal sectional view showing another embodiment of the water ring type vacuum pump according to the present invention.

Next, another embodiment as shown in FIG. 5 is described. The water ring type vacuum pump shown in FIG. 5 comprises a pump section P and a motor section M. The pump section P is so constructed that it sucks air from one side thereof and discharges air to the other side. The pump section P is connected to the motor section M by bolts 9. The pump section P includes a first casing 1 located on the sealing-water feed side, and a second casing 2 located on the motor section M side. A pump chamber 3 is defined between the first casing 1 and the second casing 2. In this pump chamber 3, an impeller 6 is rotatably provided so as to be decentered to a specified extent. The impeller 6 is secured to a rotating shaft 8. The motor section M has a drive motor (not shown) provided therein and supports the rotating shaft 8 in such a way that the rotating shaft 8 is rotatable.

The first casing 1 has at its center a water inlet 1*a* communicating with the pump chamber 3. Sealing water is fed from the water inlet 1*a* to the pump chamber 3. An air inlet 1*b* is provided diagonally upward of the water inlet 1*a*. The air inlet 1*b* communicates with the pump chamber 3. An air outlet 1*d* is provided in the second casing 2. The air outlet 1*d* communicates with the pump chamber 3.

The first casing 1 is provided with a groove 11. A partition member 12 having a flow hole 12*a* is disposed between the groove 11 and the impeller 6, and a reflux passage 10 is defined by making the flow hole 12*a* and the groove 11 communicating with each other. The reflux passage 10 makes the peripheral wall portion 3*a* and the center portion 3*b* of the pump chamber 3 communicating with each other. As in the foregoing embodiment, sealing water is flowed back through the reflux passage 10, so that air is securely prevented from leaking over the side faces of the impeller 6.

It is noted that although the groove 11 has been provided in the first casing 1 in the above embodiment, the groove 11 may instead be provided in the second casing 2. Further, the groove 11 may also be provided in both the first casing 1 and the second casing 2 as the case may be, in which case the partition member 12 is disposed for each of the grooves.

Figure 6:
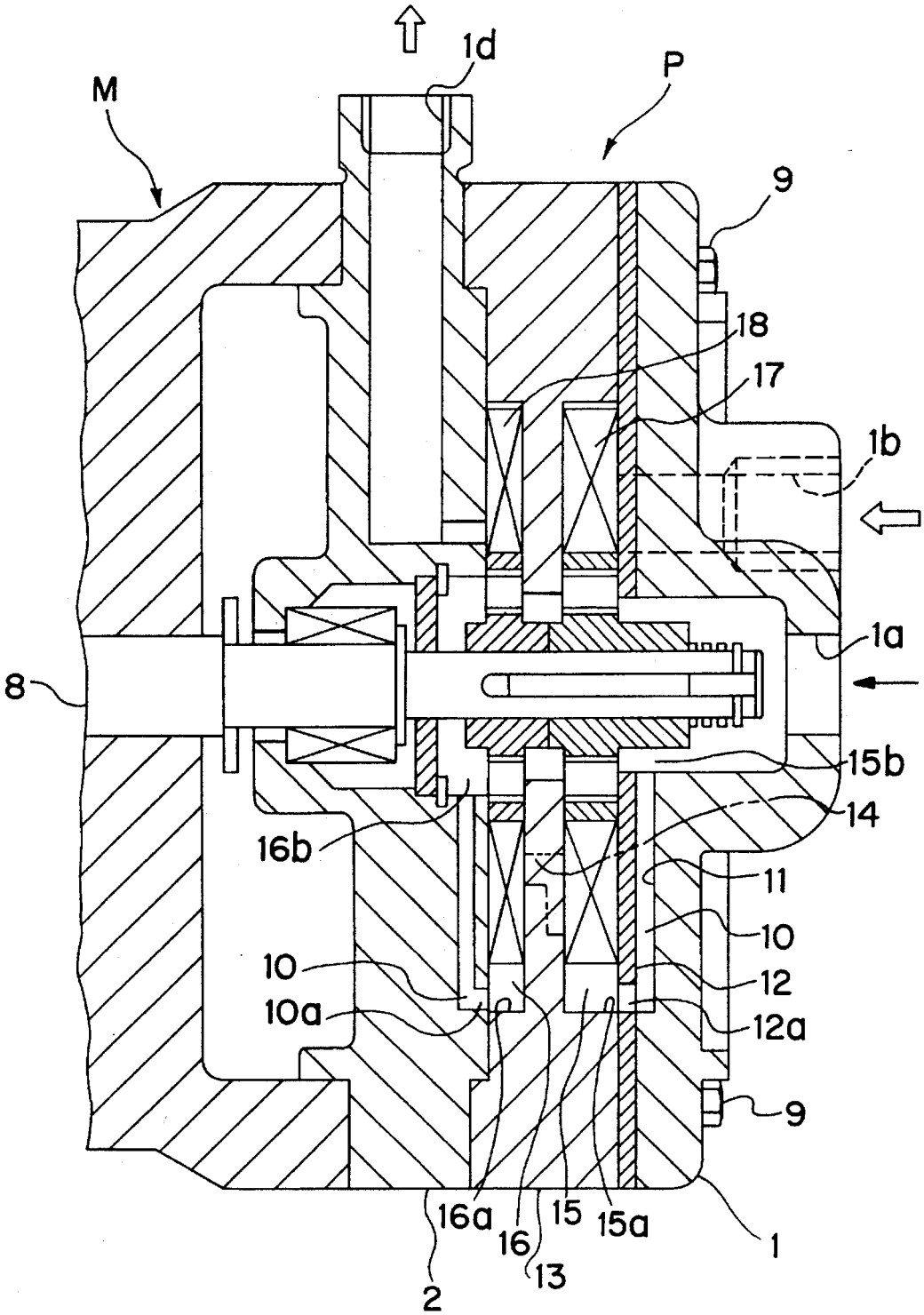
FIG. 6 is a longitudinal sectional view of yet another embodiment of the water ring type vacuum pump according to the present invention.
Figure 7:
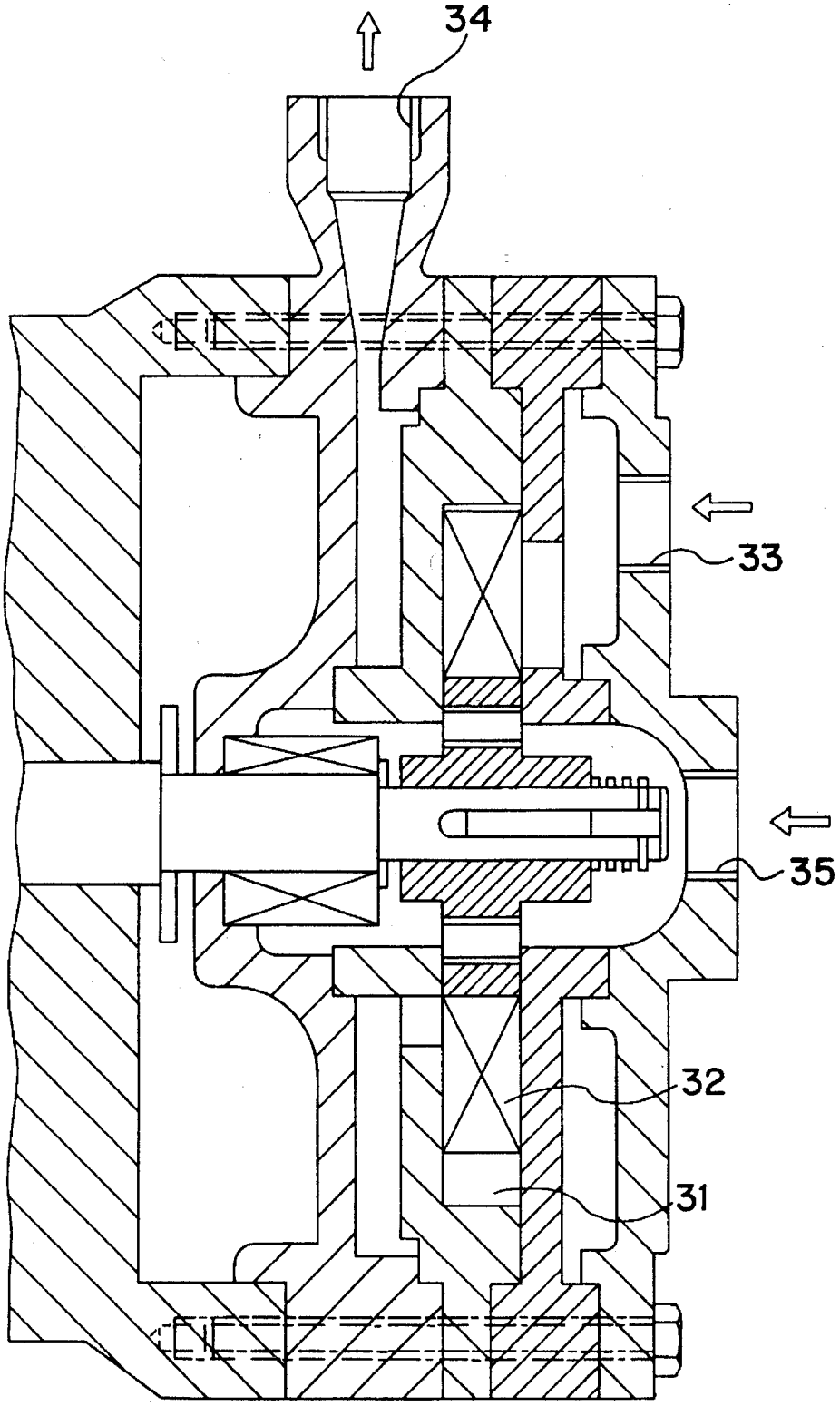
FIG. 7 PRIOR ART
FIG. 7 is a longitudinal sectional view showing an example of conventional water ring type vacuum pumps.

FIG. 6 shows an embodiment in which the present invention is applied to a two-stage water ring type vacuum pump. The water ring type vacuum pump as shown in FIG. 6 comprises a pump section P and a motor section M, wherein the pump section P is so constructed as to suck air from its one side and discharge air to the other side. The pump section P is connected to the motor section M by bolts 9. The pump section P includes a first casing 1, a second casing 2, and an intermediate casing 13 interposed between the two casings. A first pump chamber 15 is defined between the first casing 1 and the intermediate casing 13, and a second pump chamber 16 is defined between the second casing 2 and the intermediate casing 13. A first impeller 17 and a second impeller 18 are rotatably provided in the first pump chamber 15 and the second pump chamber 16, respectively, so as to be each decentered to a specified extent. The first impeller 17 and the second impeller 18 are secured to a rotating shaft 8. The motor section M has a drive motor (not shown) provided therein and supports the rotating shaft 8 in such a way that the rotating shaft 8 is rotatable.

The first casing 1 has at its center a water inlet 1*a* communicating with the first pump chamber 15 and the second pump chamber 16. Sealing water is fed from the water inlet 1*a* to the first pump chamber 15 and the second pump chamber 16. An air inlet 1*b* is provided diagonally upward of the water inlet 1*a*. The air inlet 1*b* communicates with the first pump chamber 15. An air outlet 1*d* is provided in the second casing 2. The air outlet 1*d* communicates with the second pump chamber 16. A flow hole 14 is provided in the intermediate casing 13, so that the first pump chamber 15 and the second pump chamber 16 communicate with each other by the flow hole 14.

The first casing 1 is provided with a groove 11. A partition member 12 having a flow hole 12*a* is disposed between the groove 11 and the first impeller 17, and a reflux passage 10 is defined by making the flow hole 12*a* and the groove 11 communicate with each other. The reflux passage 10 makes a peripheral wall portion 15*a* and a center portion 15*b* of the first pump chamber 15 communicating with each other. Also in the second casing 2, a reflux passage 10 is defined via an opening 10*a* so as to make a peripheral wall portion 16*a* and a center portion 16*b* of the second pump chamber 16 communicating with each other.

Now the action of the above water ring type vacuum pump is described. As the first impeller 17 and the second impeller 18 rotate, sealing water fed from the water inlet 1*a* into the first pump chamber 15 and the second pump chamber 16 circulates along the peripheral wall portion of the pump chambers, whereby air is sucked and discharged. In other words, the air sucked through the air inlet 1*b* passes the first pump chamber 15, the flow hole 14, and the second pump chamber 16, being discharged outside through the air outlet 1*d*. As in the foregoing embodiment, the sealing water is flowed back through the reflux passage 10, so that air is securely prevented from leaking over the side faces of the impellers.

The present invention, having the above-described arrangement, offers the following advantages. With the center portion and peripheral wall portion of the pump chamber communicating with each other, high-pressure sealing water at the peripheral wall portion of the pump chamber is temporarily returned to the center portion of the pump chamber, and then flowed back to the clearance between the inner wall surface of the pump chamber and both side faces of the impeller. Thus, air can be securely prevented from leaking through the clearance, so that the pump performance can be improved substantially. Further, since the sealing water is used in circulation, sealing water can be saved in the amount of use.

Also, a reflux passage is provided inside the water ring type vacuum pump, for the purpose of flowing back the sealing water, which has moved to the peripheral wall portion of the pump chamber, to the center portion of the pump chamber. By this arrangement, air leak can be securely prevented with a compact construction without the need of increasing the overall size of the water ring type vacuum pump. Moreover, in a two-stage water ring type vacuum pump, sealing water that has moved to the peripheral wall portion of the pump chamber is flowed back to the center portion of the pump chamber in both the first pump chamber and the second pump chamber. With this arrangement, a water ring type vacuum pump can be offered which is securely prevented from air leak and which has high vacuum performance.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A water ring type vacuum pump, comprising:

a pump chamber communicating with an air inlet and an air outlet and in which a water inlet for feeding sealing water to a center portion of the pump chamber is further provided;

an impeller having a plurality of blades and being rotatably disposed eccentrically within said pump chamber so as to define a pump chamber compression side and a pump chamber suction side;

a rotating shaft extending through a wall of said pump chamber and attached to said impeller for rotatably driving said impeller; and a reflux passage is provided so as to connect the peripheral wall portion and a center portion of said pump chamber with each other, wherein sealing water that has moved to the peripheral wall portion of the pump chamber is flowed back to a center portion of the pump chamber by way of an opening in a sidewall of said pump chamber, said opening being provided flush with the peripheral wall portion on the pump chamber suction side;

wherein said pump chamber is provided between a first casing and a second casing, a groove is provided in at least one of said casings, a partition member having said opening disposed therein is disposed between the groove and the impeller, and wherein a reflux passage is defined by making the opening and the groove communicate with each other.

2. The water ring type vacuum pump according to claim 1, wherein said water inlet is disposed coaxially with said rotating shaft.

3. A water ring type vacuum pump, comprising:

a first pump chamber, provided between a first casing and an intermediate casing, communicating with an air inlet and in which a water inlet for feeding sealing water to a center portion of the first pump chamber is provided;

a second pump chamber, provided between said intermediate casing and a second casing, communicating with an air outlet and communicating with said first pump chamber by a flow hole;

a first impeller and a second impeller each having a plurality of blades and being rotatably disposed eccentrically within said first pump chamber and said second pump chamber, respectively, so as to define a pump chamber compression side and a pump chamber suction side;

a rotating shaft extending through a wall of said first pump chamber and said second pump chamber and being attached to said first impeller and said second impeller for rotatably driving said impellers;

a first reflux passage is provided between said first casing and a partition wall so as to connect the peripheral wall portion and a center portion of said first pump chamber with each other by connection through a groove provided in said first casing which communicates with an opening in said partition wall, wherein sealing water that has moved to the peripheral wall portion of the first pump chamber is forced back to a center portion of the first pump chamber by way of an opening in a sidewall of said first pump chamber due to a higher pressure at the peripheral wall portion as compared to the center portion, said opening being provided flush with the peripheral wall portion on the first pump chamber suction side; and a second reflux passage is provided in said second casing so as to connect the peripheral wall portion and a center portion of said second pump chamber with each other, wherein sealing water that has moved to the peripheral wall portion of the second pump chamber is forced back to a center portion of the second pump chamber by way of an opening in a sidewall of said second pump chamber due to a higher pressure at the peripheral wall portion as compared to the center portion, said opening being provided flush with the peripheral wall portion on the second pump chamber suction side.

4. The water ring type vacuum pump according to claim 3, wherein said water inlet is disposed coaxially with said rotating shaft.

* * * * *